United States Patent [19]

Dyson

[11] Patent Number: 4,573,236

[45] Date of Patent: Mar. 4, 1986

[54] VACUUM CLEANING APPLIANCES

[75] Inventor: James Dyson, Bathford, England

[73] Assignee: Prototypes, Ltd., Bath, England

[21] Appl. No.: 627,292

[22] Filed: Jul. 2, 1984

Related U.S. Application Data

[63] Continuation-in-part of Ser. No. 452,917, Dec. 27, 1982, abandoned, which is a continuation of Ser. No. 274,252, Jun. 16, 1981, abandoned.

[30] Foreign Application Priority Data

Jul. 8, 1983 [GB] United Kingdom ..... 8318528

[51] Int. Cl.[4] ..... A47L 5/32

[52] U.S. Cl. ..... 15/333; 15/334

[58] Field of Search ..... 15/331, 332, 333, 334, 15/335, 336

[56] References Cited

U.S. PATENT DOCUMENTS

| | | | |
|---|---|---|---|
| 1,217,817 | 2/1917 | Peters . | |
| 1,338,791 | 4/1920 | Replogle . | |
| 1,533,271 | 2/1919 | Replogle . | |
| 1,887,600 | 2/1928 | Replogle . | |
| 1,936,761 | 12/1930 | Hoover . | |
| 1,953,944 | 2/1931 | Becker . | |
| 2,070,689 | 2/1937 | Smellie | 15/333 X |
| 2,174,560 | 10/1939 | Becker | 15/333 |
| 2,230,264 | 8/1936 | Replogle . | |
| 2,504,846 | 4/1950 | Kirby . | |
| 2,648,396 | 8/1953 | Kirby . | |
| 2,747,215 | 5/1956 | Segesman | 15/333 |
| 2,769,996 | 11/1956 | Shalvoy et al. . | |
| 2,769,998 | 11/1956 | Hunter . | |
| 2,850,756 | 9/1958 | Ziegler, Jr. et al. . | |
| 2,867,833 | 1/1959 | Duff . | |
| 2,876,481 | 3/1959 | Gerber et al. . | |
| 2,898,622 | 8/1959 | Hurd . | |
| 4,050,113 | 9/1977 | Wright et al. . | |
| 4,171,553 | 10/1979 | Stein . | |
| 4,376,322 | 3/1983 | Lockhart et al. . | |
| 4,377,882 | 3/1983 | Dyson . | |
| 4,393,536 | 7/1983 | Tapp . | |

*Primary Examiner*—Chris K. Moore

*Attorney, Agent, or Firm*—Ian C. McLeod

[57] ABSTRACT

A vacuum cleaning apparatus with an improved air control valve (22) for directing air flow to a passageway (11) in a casing either from a cleaning head (2) or a hose section (6) is described. In the preferred form the valve rotates to provide internal passages to the air passageway in the casing. The apparatus is particularly adapted as a vacuum cleaning appliance.

17 Claims, 7 Drawing Figures

VACUUM CLEANING APPLIANCES

CROSS-REFERENCE TO RELATED APPLICATION

This application is a continuation in-part of my U.S. patent application Ser. No. 452,917 filed Dec. 27, 1982, which is a continuation of U.S. patent application Ser. No. 274,252 filed June 16, 1981, both of which are now abandoned.

BACKGROUND OF THE INVENTION

This invention relates to an improved vacuum cleaning apparatus or appliance, and in particular to a portable domestic appliance of the kind described in my U.S. patent application Ser. No. 452,917. This U.S. application corresponds to European patent application No. 81302726.5.

U.S. patent application Ser. No. 452,917 describes a vacuum cleaning appliance comprising a generally cylindrical outer cyclone with an inlet for dirty air and concentrically within the outer cyclone an inner cyclone, a passageway being provided to allow air from the outer cyclone to enter an upper end of the inner cyclone. Clean air can then be withdrawn centrally from the inner cyclone and then exhausted. A related two cyclone appliance is shown in my U.S. Pat. No. 4,377,882.

The appliance of U.S. patent application Ser. No. 452,917 and U.S. Pat. No. 4,377,882 is adapted for use in two different modes: in the first mode dirt laden air enters the appliance via a ground engaging cleaning head which is attached to part of the lower end of the cleaner's casing and incorporates an elongate axially rotatable brushing member in the cleaning head; and in the second, pure section mode, dirt laden air enters the appliance through a pipe in a hose section, which may be connected to other suction tools, without the use of a rotatable brushing member.

The problem is to provide an efficient valving means for shifting between the two modes so that the modes operate separately from each other.

PRIOR ART

Various convertible vacuum cleaners have been described by the prior art for converting an upright vacuum cleaner to a canister vacuum cleaner with a hose. Included are U.S. Pat. Nos. 4,393,536 to Tapp; 4,377,882 to Dyson; 4,376,322 to Lockhart et al; 4,171,553 to Stein; 4,050,113 to Wright et al; 2,898,622 to Hurd; 2,876,481 to Gerber et al; 2,867,833 to Duff; 2,850,756 to Ziegler, Jr. et al; 2,769,998 to Hunter; 2,769,996 to Shalvoy et al; 2,648,396 to Kirby; 2,504,846 to Kirby; 2,230,264 to Replogle; 1,953,944 to Becker; 1,936,761 to Hoover; 1,887,600 to Replogle; 1,533,271 to Replogle; 1,338,791 to Replogle and 1,217,817 to Peters.

OBJECTS

It is an object of the present invention to provide an air flow control means or device which serves to rapidly open the inlet of the cyclone system to either the ground engaging cleaning head, or to the hose section, dependent upon whether the cleaner is to be operated in the first or second mode. These and other objects will become increasingly apparent by reference to the following description and the drawings.

IN THE DRAWINGS

GENERAL DESCRIPTION

Figure 1:
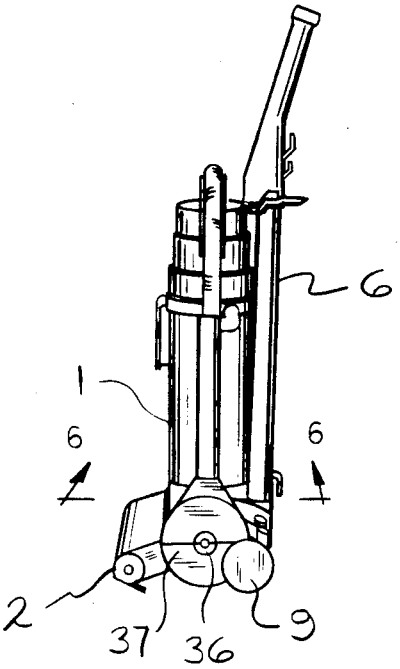
FIG. 1 is a side view of a cleaner in accordance with the present invention.

The present invention relates to a vacuum cleaning apparatus comprising a main casing (1) having a dirt laden air conveying passageway (11) leading thereto and containing a motor-driven fan unit and including means for dirt retention in the appliance from the passageway, a hose section (6) communicating with the passageway and providing an inlet for dirt laden air, a cleaning head (2) as part of a floor engaging section of the appliance mounted adjacent the main casing so as to be rotatably moveable relative to the casing to engage the floor and including a rotary brush unit (4) in the casing, the cleaning head communicating separately in relation to the hose section with the air passageway, the improvement which comprises:

an air control valve (22) selectively positionable in the air passageway and mounted on the cleaning head for selectively directing dirt laden air into the main casing from either the cleaning head or the hose section through the air passageway depending upon the position of the valve, wherein when the cleaning head is rotated to one first position relative to the main casing so that the cleaning head is connected to the passageway in the casing by the air control valve device and wherein when the casing head is in another second position, the cleaning head is disconnected from the air passageway and the passageway is connected to the hose section.

The present invention also relates to an improvement in a vacuum cleaning appliance comprising a main casing having a dirt laden air passageway (11) thereto and containing a retention in the appliance from the passageway. a socket (49) communicating with the passageway and providing an inlet for dirt laden air, a flexible hose (6) section having a first end fixedly secured to the socket and a second end, a hollow pipe member (44) connected to slide telescopically within the flexible hose section, the hollow pipe member having a lower end which is engagable with the socket when the pipe member is fully retracted into said flexible hose section and with the second end of said flexible hose section when the pipe member is fully extended, wherein the hollow pipe member functions as an inlet for dirt laden air when the lower end thereof is removed from the socket; a cleaning head (4) in a floor engaging section mounted adjacent the main casing including a rotary brush unit (4), the cleaning head communicating separately in relation to the socket with the air passageway, which improvement comprises:

an air control device (22) selectively positionable in the air passageway and mounted on said cleaning head for selectively directing dirt laden air into the main casing from either the cleaning head or the flexible hose section through the air passageway, wherein the airflow control device comprises a generally cylindrical drum (25) defining a longitudinal axis of rotation between two ends of a cylindrical surface which drum rotates with the cleaning head relative to the casing and has an axially extending sectoral appendage (26) on one end, a first passage (27) through the drum between a first inlet port (28) from the cleaning head and a first outlet port (29) to the air passageway in the casing, the ports being formed through the cylindrical surface of the drum, and a second passage (33) extending from a second outlet port (30), which second outlet port being formed through the curved surface of the drum displaced from the first outlet port, to a second inlet port (31) formed through a radial face of the sectoral appendage, wherein the second outlet port and second inlet port are communicating with the air passageway leading to the hose section when the casing is in one first position around the cylindrical surface of the drum and wherein the first inlet and outlet ports are communicating with the air passageway leading to the cleaning head when the casing is at a second position around the cylindrical surface of the drum.

For a vacuum cleaning appliance of the kind set forth above, the airflow control device (22) comprises means for selectively directing dirt laden air into the first cyclone, from either the ground engaging cleaning head (2), or the hose section (6).

In a preferred embodiment the airflow control device (22) comprises a generally cylindrical drum (25) having an axially extending sectoral appendage (26), a first passage extending diametrically (27) through said drum between a first inlet port (28) and a first outlet port (29) said ports being formed through the curved surface of the drum, and a second passage (23) extending from a second outlet (30) port, which port (30) being formed through the curved surface of the drum displaced about 30° from the first outlet port, to a second inlet port (31) formed through a radial face of the sectoral appendage.

SPECIFIC DESCRIPTION

The particular embodiment of the invention will now be described.

Figure 3:
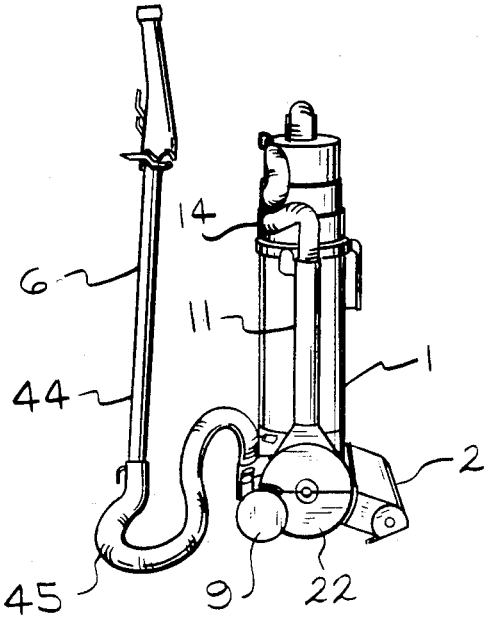
FIG. 3 is a side view of the cleaner in the second mode.
Figure 2:
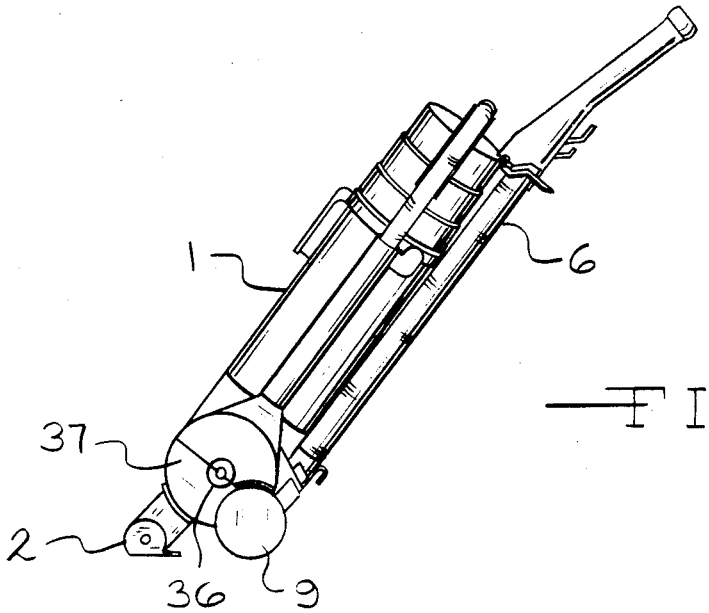
FIG. 2 is a side view of the cleaner in the first mode.

The cleaner shown in FIG. 1 is generally as described and illustrated in U.S. patent application Ser. No. 452,917 and where possible, corresponding parts have been given the same reference numerals. With particular reference to FIGS. 1, 2 and 3, the cleaner comprises a main casing 1 which preferably houses two concentric cyclones; an outer larger dirt particle removing cyclone and a fine dirt particle cyclone. A standard vacuum cleaner casing might be used. At the lower end part of the casing 1 a pivotal cleaning head 2 is provided, which head 2 houses an elongate transversely extending brushing member 4 (see FIGS. 5 and 6). A conventional motor driven fan unit (not shown) is located within the lower end part of the casing 1, said motor being connected to the brushing member 4 by a flexible belt (not shown).

A wand assembly 6 upstands along the back of the casing 1 and serves as a handle, or for a connection to other suction tools. A dirty air passage 11 communicates between the entry port 14 of the outer cyclone and the cleaning head 2, or the wand assembly 6. In European patent specification No. 81302726.5 reference was made to the provision of an airflow control device 22, which device being rotatable to close airflow from the cleaning head 2 and to open the air passage to the pipe 6.

Said device 22 will now be described in detail with particular reference to FIG. 4. An airflow control device 22 comprises a cylindrical drum 25 having an axially extending sectoral appendage 26. A first passage 27 extends diametrically through the drum 25 from a first inlet port 28 to a first outlet port 29, both ports 28 and 29 being formed through the outer surface of the drum 25. A second outlet port 30 is formed through the curved surface of the drum 25, displaced about 30° from the first outlet port 29. A second inlet port 31 is formed through a radial face 32 of the sectoral appendage 26. Said second outlet port 30 and said second inlet port 31 communicate via a cranked passage 33.

A hole 34 is formed through the sectoral face 35 of the sectoral appendage 26 into the first passage 27.

The function of the airflow control device 22 will now be described with particular reference to FIGS. 2, 3, 5 and 6. The airflow control device 22 is located to one side of the lower part of the casing 1, directly below the lower end of the dirty air passage 11. The device 22 is rotatable about the axis of rotational symmetry of the drum part 25, which axis passes through the hole 34 and lies across the cleaner, parallel to that of the brushing member 4.

One end part of the cleaning head 2 is located by a bearing assembly 36 and an arm 37; the rotational axis of the bearing 36 being the same as that about which the airflow control device 22 is rotatable. The other end part of the cleaning head 2 is rigidly fixed to the airflow control device 22 by a dirty air passage 38 which extends from the cleaning head 2, and is spigoted into the first passage 27, via the first inlet port 28.

Figure 5:
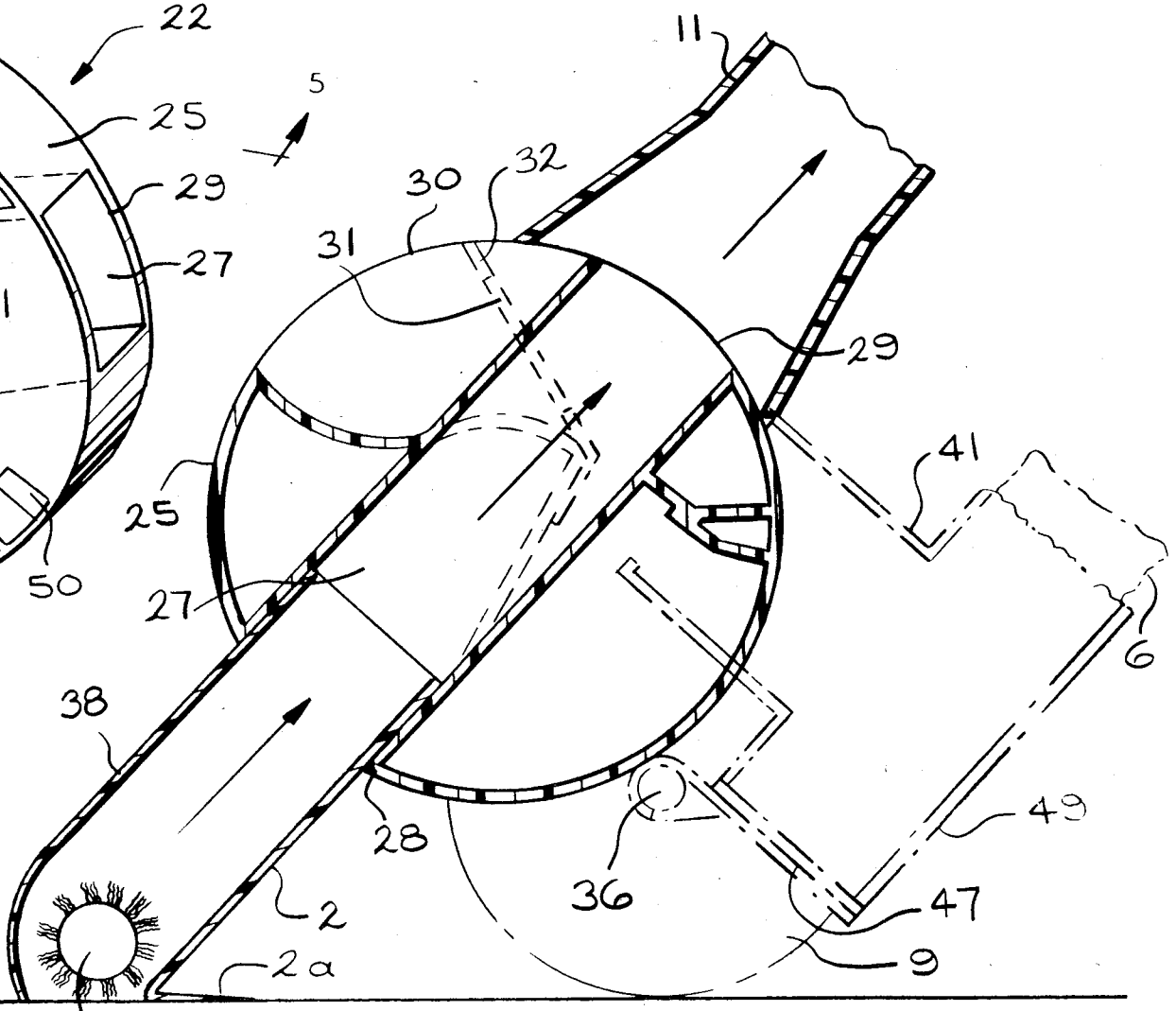
FIG. 5 is a schematic sectional diagram showing the position of the airflow control device, when the cleaner is in the first mode as shown in FIG. 2.

When the cleaner is in use in the first mode the airflow control device 22 is in the position shown in FIG. 5, where the dirty air passage 11, the first air passage 27 and the dirty air passage 38 are all in alignment. When the motor driven fan is activated the airflow from the cleaning head 2 into the dirty air passage 11 would follow the direction indicated by arrows as shown in FIG. 5.

Figures 6, 7:
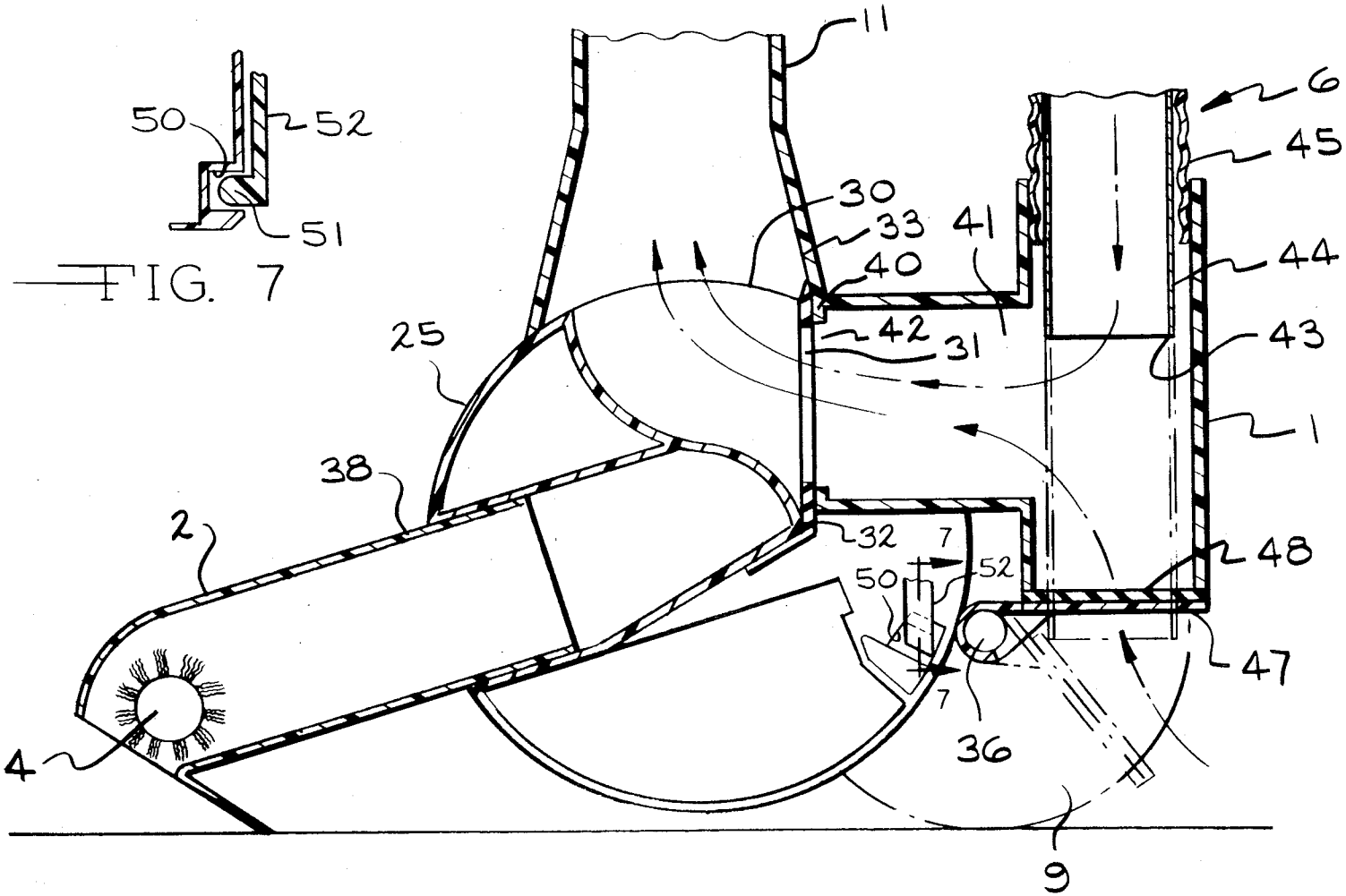
FIG. 6 is a schematic sectional diagram showing the position of the airflow control device when the cleaner is in the second mode as shown in FIG. 3.
FIG. 7 is a side view of a partial cross-section along line 7—7 of FIG. 6, showing a recess and detent for holding the vacuum cleaner in an upright position.

When the cleaner is in use in the second mode the airflow control device 22 is in the position shown in FIG. 6. The open lower end of the dirty air passage 11 is aligned with the second outlet port 30 and the radial face 32 of the sectoral appendage 26 is in abutment with a bulkhead 40, which bulkhead 40 forms part of the casing 1. The bulkhead 40 is formed at one end of an internal passage 41 and defines an outlet port 42 from said passage 41. The passage 41 extends from the outlet port 42, through the socket 49 in casing 1 of the cleaner to the lower open end 43 of the wand 6.

The wand 6 comprises concentric inner tube 44 and an outer tube 45, the inner tube 44 being rigid and slidably mounted within the flexible and extensible outer tube 45. The lower end part of the outer tube is fixed to the casing 1, whereas the inner tube 44 is free to slide. When the wand 6 is in use as a handle and at all times when it is attached to the cleaner, as shown in FIGS. 1 and 2, the inner tube 44 of the wand 6 extends to a lower position, shown in chain dotted lines in FIG. 6.

A flap 47 is hingedly mounted to an axle 36, said flap 47 is spring biased to abut the underside of the socket 49 in casing 1, so as to seal an orifice 48 in the socket 49. The orifice 48 leads into the internal passage 41 directly below the wand 6. When the inner tube 46 of the wand 6 extends to the lower, chain dotted position, the flap or cover 47 is held away from the orifice 48 by the open end of the inner tube 46; in FIG. 6 the flap is shown in said position in chain dotted lines. When the orifice 48 is open, and the motor driven fan is activated, the air would enter the cleaner through said orifice 48 and flow through the passages 41 and 33 and into the dirty air passage 11 as shown by the arrows, except that the passage is closed by the tube 44. As soon as the inner tube 44 of the wand 6 is moved up from its lower position, for instance when in use as shown in FIG. 3, the flap 47 springs up to close the orifice 48, thus the airflow would follow the solid arrows, down the wand 6, through the passages 41 and 33 and into the passage 11. The flap 47 when open as shown by the dotted lines in FIG. 6 disengages any air flow through the pipe member 44. This is a safety feature and prevents a person, particularly children from looking into the handle end of the hose section 6 in the portions of the vacuum cleaner in FIGS. 1 and 3. Only when the hose section 6 is in the position shown in FIG. 3 is the hose section 6 conveying air to the cleaner.

A pair of wheels 9 are located on the end parts of the axle 36, which axle is fixed to the rear part of the cleaner casing 1. The wheels 9 provide the means whereby the cleaner may be moved about, when it is in use in the first mode, and, in conjunction with the axle 36, the wheels 9 provide a pivot about which the cleaner casing 1 is rotated when its mode of operation is being changed between the cleaning head 2 and tube 45.

A recess 50 is provided on an air control valve 22 for a corresponding rounded face detent 51 as shown in FIG. 7 with an arm 52 mounted on the casing 1. This recess 50 and detent 51 holds the cleaning head in an upright position as shown in FIGS. 1 and 6. Other holding means can be used for the air control valve 22; however, the recess 50 and detent 51 is easy to use.

Figure 4:
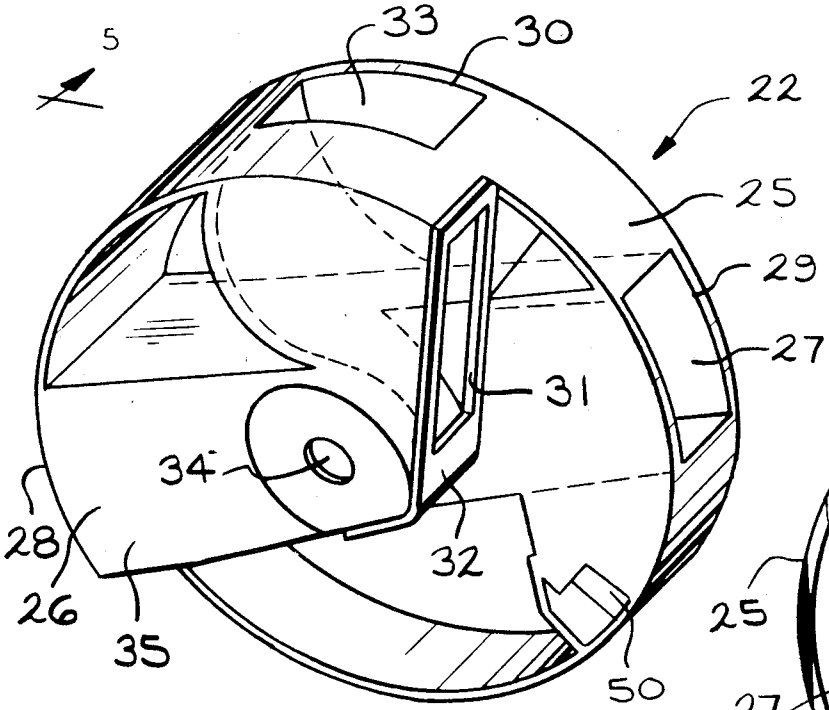
FIG. 4 is a perspective view of the airflow control device removed from the cleaner shown in FIGS. 1–3.

As shown in FIGS. 1, 4 and FIG. 6, when the vacuum cleaning appliance is in the upright position, the rotary brush unit 4 is held off the floor by the extension *2a* of the cleaning head 2. This prevents the brush unit 4 from rotating on the floor and damaging carpet and the like while the vacuum cleaning appliance is in the upright position especially when the hose section 6 is in use. This is a particularly useful feature of the vacuum cleaner of the present invention.

In order to change the mode of the cleaner from, for example the first mode as shown in FIG. 2 to the second mode as shown in FIG. 3, the following needs to be done; the cleaner should be pivoted from the inclined position, as shown in FIG. 2, to the upright position as shown in FIG. 3; the wand 6 should be then disengaged from the cleaner, and the inner tube 44 extended from the outer tube 45 to the position shown in FIG. 3. A reversal of this procedure would obviously have the effect of converting the cleaner from the second mode to the first mode.

The airflow control device 22 is caused to remain still relative to the cleaner casing 1, when said casing 1 is rotated from the inclined position to the upright position, because the cleaning head 2 is in abutment with the ground and cannot be rotated any further in the direction which is anti-clockwise in FIGS. 2, 5 and 6. Additionally the airflow control device 22 is caused to remain still relative to the cleaner casing 1, when said casing is rotated from the upright position to the inclined position, because the cleaning head 2 is caused to remain in abutment with the ground by virtue of its mass.

It will be appreciated that the air control valve means can take various forms besides the preferred embodiment shown herein. Thus for instance the ports to passageways could be on the sides of the drum. Further the flexible outer tube 45 can be used without the inner tube 45 as a handle for the vacuum cleaner. All of these variations will be obvious to one skilled in the art.

It will be appreciated that when a cyclone type cleaner with an inner and outer cyclone as described in U.S. patent application Ser. No. 452,917 is used on the vacuum cleaning appliance, that the inner cyclone can be concentric with the outer cyclone or offset to one side. Further the cyclones can be separate from each other. Further still, the vacuum cleaner can be of the conventional bag type. All of these variations will be obvious to one skilled in the art.

I claim:

1. In a vacuum cleaning apparatus comprising a main casing having a dirt laden air conveying passageway leading thereto and containing a motor-driven fan unit, and including means for dirt retention in the apparatus, a hose section communicating with the passageway and providing an inlet for dirt laden air, a cleaning head as part of a floor engaging section of the apparatus mounted adjacent the main casing so as to be rotatably moveable relative to the casing to engage the floor and including a rotary brush unit in the casing, the cleaning head communicating separately in relation to the hose section with the air passageway, the improvement which comprises:

an air control valve means selectively positionable with the air passageway and mounted on the cleaning head for selectively directing dirt laden air into the main casing from either the cleaning head or the hose section through the air passageway depending upon the position of the valve; wherein, when the cleaning head is rotated to one first position relative to the main casing, the cleaning head is connected to the passageway in the casing by the air control valve means; and when the cleaning head is rotated to a second position, the cleaning head is disconnected from the air passageway and the passageway is connected to the hose section by the air control valve means.

2. The apparatus of claim 1 wherein when the cleaning head is in the second position the brush unit on the cleaning head is disengaged from the floor.

3. The apparatus of claim 1 wherein the air control valve means is a rotary two way valve rotatably mounted on the cleaning head such that the cleaning head is connected to the passageway in the first position and the passageway to the hose section in the second position.

4. The apparatus of claim 1 wherein the hose section includes a flexible hose for cleaning.

5. The apparatus of claim 1 wherein the hose section includes a flexible hose for cleaning having a first end fixedly secured to a socket communicating with the passageway and wherein a hollow pipe member slides telescopically in the flexible hose and into the socket to serve as a handle for the appliance and to close the passageway in the first position of the cleaning head.

6. In a vacuum cleaning appliance comprising a main casing having a dirt laden air passageway leading thereto, and containing a motor-driven suction fan unit and including means for dirt retention in the appliance, a socket communicating with the passageway and providing an inlet for dirt laden air, a flexible hose section having a first end fixedly secured to the socket and a second end; a hollow pipe member connected to slide telescopically within the flexible hose section, the hollow pipe member having a lower end which is engagable with the socket when the pipe member is fully retracted into said flexible hose section and with the second end of said flexible hose section when the pipe member is fully extended, wherein the hollow pipe member functions as an inlet for dirt laden air when the lower end thereof is removed from the socket; a cleaning head in a floor engaging section mounted adjacent the main casing including a rotary brush unit, the cleaning head communicating separately in relation to the socket with the air passageway, the improvement which comprises:

an air control device selectively positionable with the air passageway and mounted on said cleaning head for selectively directing dirt laden air into the main casing from either the cleaning head or the flexible hose section through the air passageway, wherein the airflow control device comprises a generally cylindrical drum defining a longitudinal axis of rotation between two ends of a cylindrical surface, which drum rotates with the cleaning head relative to the casing and has an axially extending sectoral appendage on one end, a first passage through the drum between a first inlet port from the cleaning head and a first outlet port to the air passageway in the casing, the ports being formed through the cylindrical surface of the drum, and a second passage extending from a second outlet port, which second outlet port being formed through the curved surface of the drum displaced from the first outlet port, to a second inlet port formed through a radial face of the sectoral appendage, wherein the second outlet port and second inlet port communicate the air passageway with the hose section when the casing is in one first position around the cylindrical surface of the drum, and when the first inlet and outlet ports communicate the air passageway with the cleaning head when the casing is at a second position around the cylindrical surface of the drum.

7. The appliance of claim 6 wherein when the lower end of the hollow pipe member engages the socket a spring loaded valve cover is unseated from a portion of the socket and the socket is closed by the pipe member to essentially prevent air entry into the air passageway.

8. The appliance of claim 7 wherein the pipe provides a handle for the appliance when engaged with the socket and when the cleaning head is in the first position.

9. The appliance of claim 6 wherein the casing and cleaning head are upright so as to be generally at right angles to each other when the second inlet and outlet ports are in communication with the air passageway, and wherein the pipe is removed from the socket to allow air flow through the air passageway between the casing and flexible hose when the casing and cleaning head are upright.

10. The appliance of claim 6 wherein the second outlet port is displaced about 30° from the first outlet port on the cylindrical surface of the drum.

11. The appliance of claim 6 wherein the first passage extends diametrically through the drum and the second outlet port is about 30° from the first outlet port.

12. The appliance of claim 6 wherein when the lower end of the hollow pipe member engages the socket a spring loaded valve cover is unseated from a portion of the socket and the socket is closed by the pipe member to essentially prevent air flow into the passageway, and wherein the pipe provides a handle for the appliance when engaged with the socket when the cleaning head is in the first position.

13. The appliance of claim 6 wherein in the second position the brush unit on the brush unit on the cleaning head is disengaged from the floor.

14. The appliance of claim 6 wherein the second inlet opening to the air control device has a face seal which engages an opening in the casing when the cleaning head is in the second position.

15. In a vacuum cleaning apparatus comprising a main casing having a dirt laden air conveying passageway leading thereto and containing a motor-driven fan unit and including means for dirt retention in the apparatus, a hose section communicating with the passageway and providing an inlet for dirt laden air, a cleaning head as part of a floor engaging section of the apparatus mounted adjacent the main casing so as to be rotatably moveable relative to the casing to engage the floor and including a rotary brush unit in the casing, the cleaning head communicating separately in relation to the hose section with the air passageway, the improvement which comprises:

valve means for directing dirt laden air into the main casing from the hose section or the cleaning head through the passageway depending upon the position of the valve, wherein when the cleaning head is rotated to a first position relative to the main casing and cleaning head can be used to clean the floor using the brush unit, and when the hose section is to be used the cleaning head is rotated to a second position with the brush unit of the cleaning head disengaged from the floor with a projection from the cleaning head which engages the floor.

16. The apparatus of claim 15 wherein the valve selectively directs the dirt laden air from the cleaning head in the first position and from the hose section in the second position.

17. The apparatus of claim 1 wherein the valve means is connected to the cleaning head and opens and closes the passageway from the hose means in response to rotation of the cleaning head between the first and second positions.

* * * * *

UNITED STATES PATENT AND TRADEMARK OFFICE

CERTIFICATE OF CORRECTION

PATENT NO. : 4,573,236

DATED : March 4, 1986

INVENTOR(S) : James Dyson

It is certified that error appears in the above-identified patent and that said Letters Patent are hereby corrected as shown below:

Column 1, line 37 "section" should be --suction--.

Column 8, line 47 "and" should be --the--.

Signed and Sealed this

*Twenty-ninth* Day of *July 1986*

[SEAL]

*Attest:*

DONALD J. QUIGG

*Attesting Officer*

*Commissioner of Patents and Trademarks*